United States Patent [19]

De Angelis

[11] 4,406,638

[45] Sep. 27, 1983

[54] SYSTEM FOR REMOVING SHADOW MASK ASSEMBLIES FROM KINESCOPE PANELS OF VARYING SIZES

[75] Inventor: Mario E. De Angelis, Lancaster, Pa.

[73] Assignee: RCA Corporation, New York, N.Y.

[21] Appl. No.: 290,472

[22] Filed: Aug. 6, 1981

[51] Int. Cl.[3] ..... H01J 9/18

[52] U.S. Cl. ..... 445/68; 29/426.6

[58] Field of Search ..... 445/45, 68, 66; 269/908, 118, 121, 242; 29/426.6

[56] References Cited

U.S. PATENT DOCUMENTS

| | | | |
|---|---|---|---|
| 3,279,783 | 10/1966 | Blankenship | 269/908 X |
| 3,290,039 | 12/1966 | Lancaster | 269/242 X |
| 3,724,740 | 4/1973 | Imamura et al. | 445/66 X |
| 4,164,060 | 8/1979 | Hartta | 445/68 |

*Primary Examiner*—Kenneth J. Ramsey

*Attorney, Agent, or Firm*—Eugene M. Whitacre; Dennis H. Irlbeck; Lester L. Hallacher

[57] ABSTRACT

A system for removing shadow mask assemblies from kinescope panels of all sizes includes slidable blade mounts arranged to move parallel to the axes of the panel toward the 12, 3, 6, and 9 o'clock stud positions of the panel. The motion along the major axis is independent of the motion along the minor axis. Each blade mount supports a plurality of blades determined by the number of stud positions for the various sizes of panels. The system includes means for sensing the panel to establish the size of the panels and means for centering the panels. The blades required for a particular size panel are actuated and the shadow mask assembly removed from the panel.

15 Claims, 7 Drawing Figures

SYSTEM FOR REMOVING SHADOW MASK ASSEMBLIES FROM KINESCOPE PANELS OF VARYING SIZES

BACKGROUND OF THE INVENTION

This invention relates generally to the production of kinescopes and particularly, to a system for removing shadow mask assemblies from kinescope panels of various sizes.

Kinescopes for color television receivers include a screen composed of phosphors which emit light of different colors when impacted by electrons. During the production of the screens, a phosphor slurry is coated onto the entire inside surface of the panel which supports the screen. The excess slurry is removed and a shadow mask assembly is inserted into the panel. The phosphor is then exposed to light through the apertures in the shadow mask. The shadow mask assembly is then removed and the unexposed slurry washed away leaving the lightexposed phosphor in the desired location. This process is then repeated for the phosphors of the other two colors. Accordingly, during the production of the screen, the shadow mask assembly is frequently removed from and inserted into the panel. This continual removal and insertion is a labor intensive and expensive operation and frequently results in damage to the shadow mask assembly.

Prior art attempts at automating the shadow mask assembly removal operation have had limited success because typically the automatic removing equipment is capable of removing the shadow mask assemblies from a very limited number of panel sizes. Accordingly, when automatic removal is utilized, a change of panel size typically requires changing the mask removing equipment.

For these reasons, there has long been a need for a system which is capable of removing shadow mask assemblies from panels of many sizes as the panels proceed along a production line in random order.

The instant invention overcomes the above difficulties and solves the long felt need by the provision of a system for removing shadow mask assemblies from kinescope panels of varying sizes. The system automatically senses the size of the panel and centers the panel so that shadow mask assemblies can be removed from panels which flow along the production line in random order of size.

SUMMARY OF THE INVENTION

A system for removing shadow mask assemblies from kinescope panels of varying sizes in which the panels include mounting studs at particular positions with respect to the major and minor axes of the panels. The shadow mask assemblies include apertured retaining springs engaging the studs. The system includes a first pair of blade mounts arranged to simultaneously move in opposite directions substantially parallel to the major axis. A second pair of blade mounts is arranged to simultaneously move in opposite directions substantially parallel to the minor axis. The blade mounts include means for sensing the size of the panels and means for centering the panels. Each of the blade mounts supports a number of blades determined by the number of stud locations at each position whereby the shadow mask frame assemblies can be removed from all sizes of panels.

DETAILED DESCRIPTION OF THE PREFERRED EMBODIMENT

Figure 1:
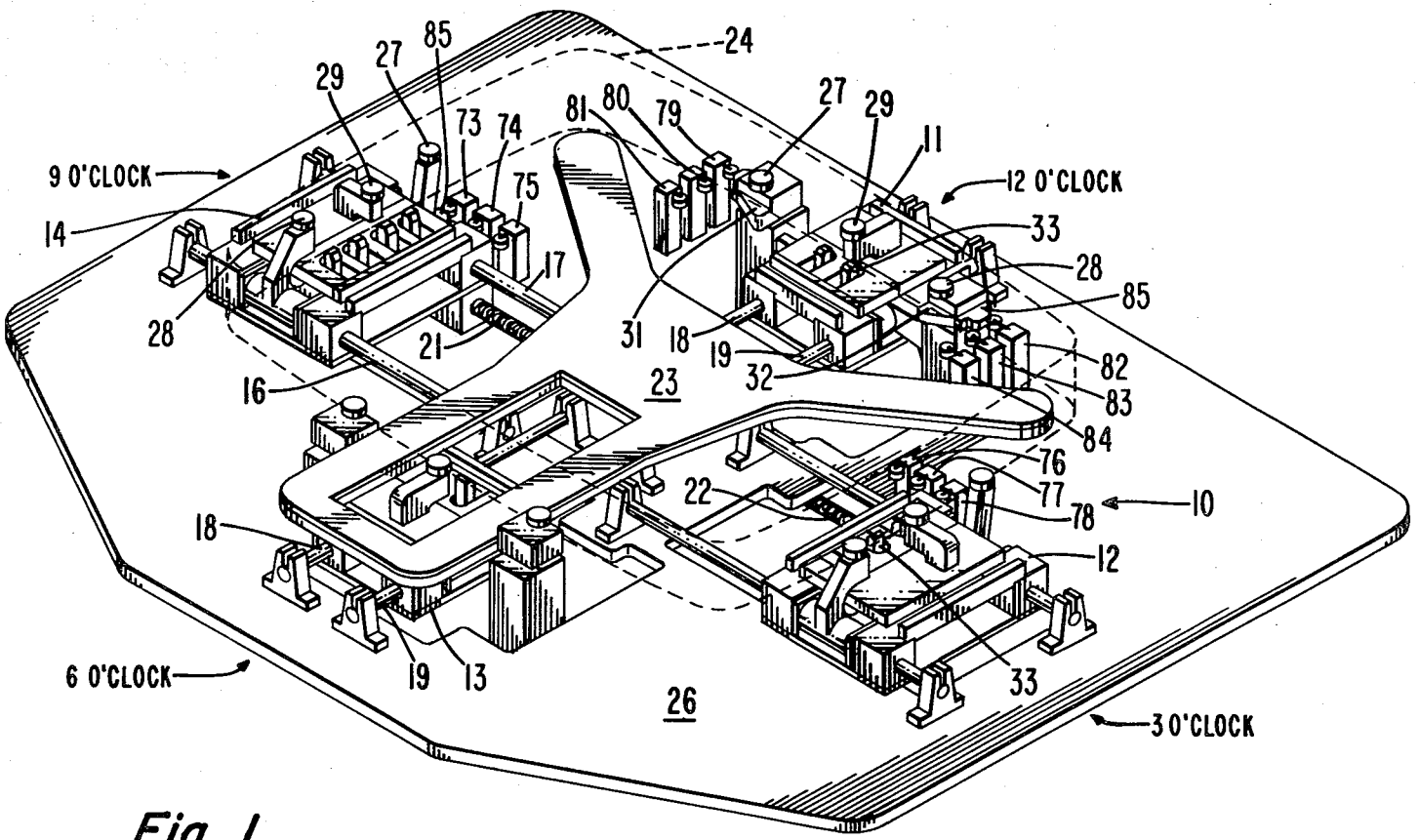
FIG. 1 is a perspective of a preferred embodiment.

In FIG. 1, a shadow mask frame assembly removing device 10 includes four slidable blade mounts 11, 12, 13 and 14, respectively, arranged at the 12 o'clock, 3 o'clock, 6 o'clock and 9 o'clock positions. The blade mounts 12 and 14 are arranged to slide toward and away from one another on two slide rods 16 and 17. The blade mounts 11 and 13 are arranged to slide toward and away from one another on slide rods 18 and 19. The blade mounts 12 and 14 are driven by two opposite-threaded lead screws 21 and 22 which are rotated by a motor (not shown) so that the blade mounts simultaneously move in opposite directions during rotation of the lead screws 21 and 22. The blade mounts 11 and 13 are similarly driven by lead screws and a drive motor, which are not shown in FIG. 1.

A panel support 23 is positioned parallel to a stationary cover plate 26 with the edge of the panel 24 in a plane which is parallel to the plane of travel of the blade mounts 11, 12, 13 and 14. The panel support 23 receives kinescope panels 24, shown in the phantom lines, of any size 13 V, 15 V, 17 V, 19 V, 21 V or 25 V. The panel 24 can be placed onto the panel support 23 either manually or automatically without regard to the exact orientation or centering. If desired, the panel support 23 can be made to be movable vertically to assist in placing and removing panels onto and off of the support. Each of the blade mounts 11, 12, 13 and 14 includes two centering bumpers 27 and 28 and a blade positioning bumper 29. The four blade mounts travel toward the center of the panel support 23 along paths substantially parallel to the major and minor axes of the panel after centering and in a plane parallel to the plane of the panel. The blade positioning bumpers 29 first engage the sides of the panel 24 and remain in such engagement while the centering rollers 27 and 28 approach the panel. After the panel is centered, the drive mechanism is stopped with the blades located in the proper positions with respect to the sides of the panel 24. The centering bumpers 27 and 28 firmly engage the sides of the panel to maintain the orientation and centering of the panel with respect to the blades.

The blade mount 11 is provided with panel lifting surfaces 31 and 32. The blade mount 13 also includes panel lifting surfaces (not shown). Each of the blade mounts 11 through 14 contains a plurality of apertures 33 which receive the blade assemblies used to disengage the panel 24 and the shadow mask frame assembly (not shown). The number and positioning of the blades for each of the blade mounts 11 through 14 is described in detail hereinafter with respect to FIG. 5. When the panel 24 is properly centered and oriented, the seal edges of the panel sides rest on the panel lifting surfaces 31 and 32 of the mounts 11 and 12. After the blades disengage the shadow mask frame assembly from the panel, the panel lifting surfaces 31 and 32 are moved upwardly perpendicular to the plane of the panel to separate the glass panel 24 and the shadow mask assembly.

Figure 2:
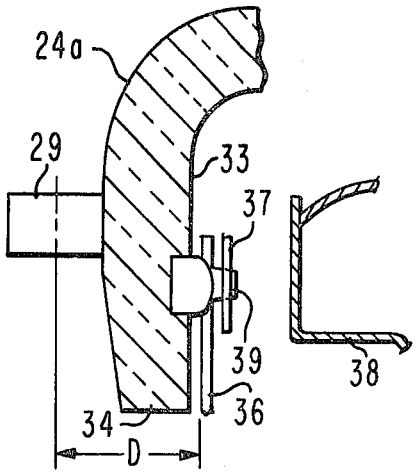
FIG. 2 is a cross section view, partially broken away, showing how the blades remove the shadow mask frame assemblies from the panels.

FIG. 2 shows a shadow mask frame 38 and the inside surface 33 of a panel sidewall 24*a*, the rest of which is broken away. The seal edge 34 of the panel 24*a* rests on the panel support 23 and the panel lifting surfaces 31 and 32 of the blade mounts 11 and 13 (FIG. 1). The positioning bumper 29 engages the outside surface of the sidewall 24*a* to position a blade 36, when in the extended position illustrated, between the inside surface 33 of the sidewall 24*a* and a leaf spring 37. The spring 37 is fixed to the shadow mask frame 38 by welding, or other technique. The spacing D between the centering of the positioning bumper 29 and the surface of the blade 36 is substantially constant for all panel sizes and is a design parameter of the inventive system. Additionally, the thickness of the sidewalls 24*a* for panels of all size panels is substantially the same so that the blades 36 when extended are positioned between the inside surface of the panel sidewall 33 and the spring 37 for all sizes of panels. A metal stud 39 is embedded in the sidewall 33 and the shadow mask frame assembly 38 is held to the stud by an aperture present in the leaf spring 37. When removing the spring 37 from the stud 39, the blade 36 moves toward the frame 38 to bias the spring 37 away from the sidewall 33 to disengage the spring from the stud.

Figure 3:
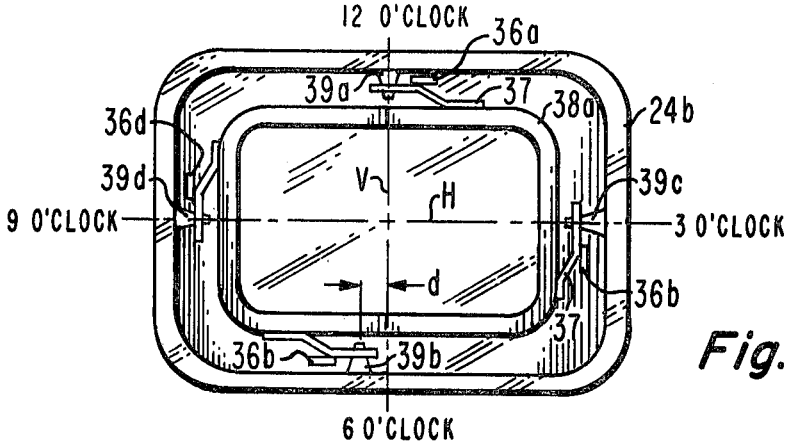
FIG. 3 shows the locations of the studs and springs for 19 V, 21 V and 25 V panels.

FIG. 3 shows the stud locations with respect to the major, or horizontal, axis H and the minor, or vertical, axis V for the 19 V, 21 V and 25 V panels. The 12 o'clock stud 39*a* is centered on the vertical axis V and the 6 o'clock stud 39B is displaced from the vertical axis V by the distance d. The 3 o'clock stud 39*c* and the 9 o'clock stud 39*d* are centered on the horizontal axis H. The distance d is substantially the same for 19 V, 21 V and 25 V panels. Also, the ratio of the horizontal dimension to the vertical dimension of the three panel sizes is substantially the same. Accordingly, the locations of the blades 36*a*, 36*b*, 36*c* and 36*d* are determined by the locations of the studs with respect to the H and V axes independently of the size of the panels. For this reason, only one blade is required at each of the 12 o'clock, 3 o'clock, 6 o'clock and 9 o'clock positions for the three panel sizes 19 V, 21 V and 25 V.

The shadow mask frame assembly 38*a* has affixed thereto a plurality of the leaf springs 37. Each of the springs 37 contains an aperture to engage the lugs 39*a* through 39*d*. The blades, when extended, are positioned between the springs 37 and the inside surface of the panel 24*b* sidewall in the manner illustrated in FIG. 2. The simultaneous motion of the four blades toward the panel center causes the deformation of the springs 37 and the disengagement of the springs from the studs 39*a* through 39*d*.

Figure 4:
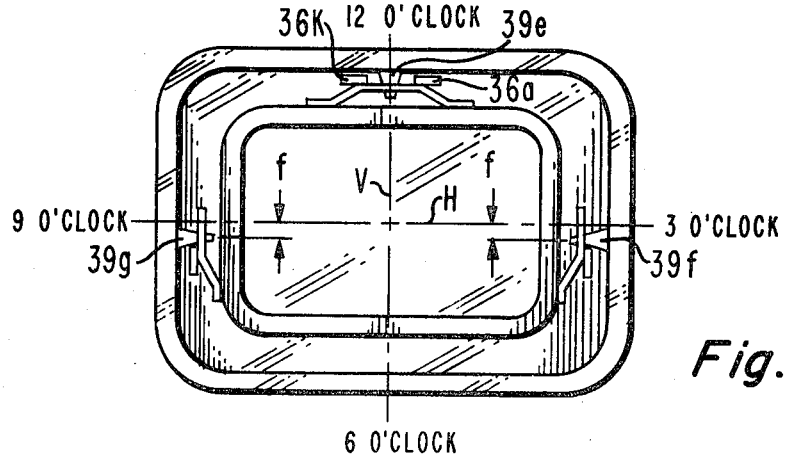
FIG. 4 shows the location of the studs and springs for the 13 V, 15 V and 17 V panels.

FIG. 4 shows the positions of the studs 39*e*, 39*f* and 39*g* with respect to the horizontal axis H and the vertical axis V for 13 V, 15 V and 17 V panels. The 12 o'clock stud 39*e* is centered on the vertical axis V and the 3 o'clock and 9 o'clock studs are displaced from the horizontal axis H by a dimension f. The dimension f is different for 13 V, 15 V and 17 V panels (f=0 for 13 V panels) and accordingly, a separate blade is required at each of these positions for each of the panel sizes. The 13 V, 15 *V and* 17 V panels do not utilize a stud at the 6 o'clock position. Accordingly, the blade used at this position merely prevents the frame assembly from moving when the 12 o'clock spring is compressed. The retaining spring at the 12 o'clock position is a bow spring and therefore two blades 36*a* and 36*k* must simultaneously compress the spring to disengage the spring from the stud 39*e*. The horizontal and vertical axes H and V, respectively, of FIGS. 3 and 4 and the ratio of the horizontal and vertical dimensions are common to all size panels and accordingly, many of the blades can be used for all sizes of panels.

Figure 5:
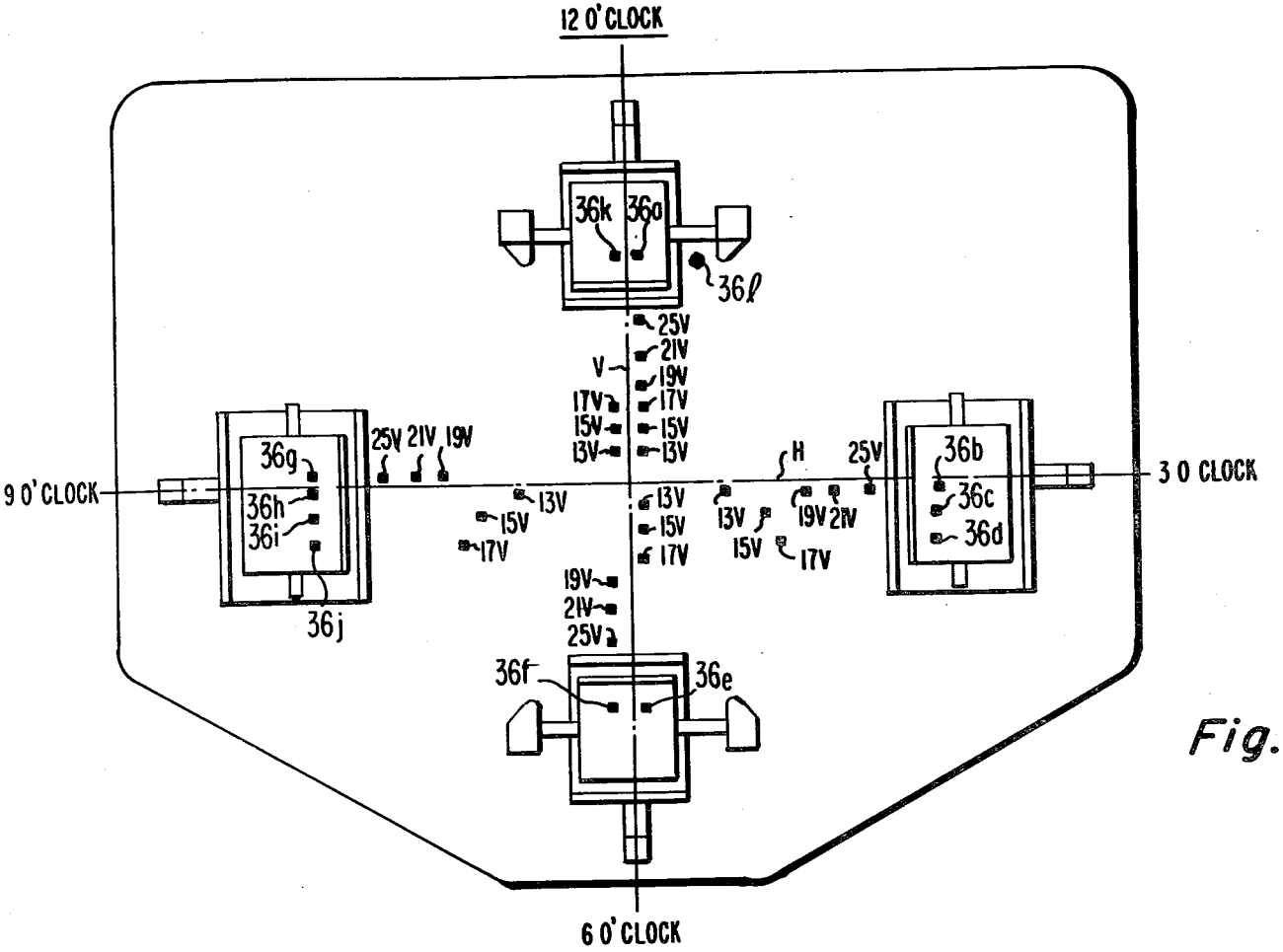
FIG. 5 is a simplified plan view showing the number of blades and operating positions for the various sizes of kinescope panels at the 12, 3, 6 and 9 o'clock positions.

FIG. 5 shows how the number and operative locations of the blades at the 12 o'clock, 3 o'clock, 6 o'clock and 9 o'clock positions varies for the different sizes of panels. The 12 o'clock blade 36*a* is common to all panel sizes and operates in the locations 25 V through 13 V shown in FIG. 5. The blade 36*b* at the 3 o'clock position is displaced from the horizontal axis H and operates for the 13 V, 19 V, 21 V and 25 V panels in the locations shown. The blade 36*c* at the 3 o'clock position operates only with 15 V panels, and the blade 36*d* operates only with 17 V panels. The 3 o'clock mount therefore supports three blades which are displaced differently from horizontal axis H. The blade 36*e* at the 6 o'clock position operates with 17 V, 15 V and 13 V panels and is displaced from the vertical axis V. The blade 36*f* is displaced on the other side of the vertical axis V and operates with the 19 V, 21 V and 25 V panels. The 13 V, 15 V and 17 V panels do not have a stud at the 6 o'clock position and therefore the blade 36*e* acts against the outside of the shadow mask frame assembly to hold the frame against motion during the compression of the spring at the 12 o'clock position. The 6 o'clock mount therefore supports two of the spring compression blades.

The 9 o'clock mount supports four blades. The blade 36*g* is displaced above the horizontal axis H and operates with 25 V, 21 V and 19 V panels. The blades 36*h*, *36i* and 36*j* are located at different displacements from the horizontal axis and individually operate for 13 V, 15 V and 17 V panels, respectively. The blade 36*k* at the 12 o'clock position is used along with the blade 36*a* to compress bow springs for 17 V, 15 V and 13 V panels. An antirotation blade 36l is arranged at the 12 o'clock position to prevent rotation of the frame assembly due to the displacement of the compressing blade from the H and V axes.

The tube sizes with which each of the blades 36*a* to 36*l* are used are shown in Table I.

TABLE I

| Blade Mount | Blade | Used With Tube Sizes | | | | | |
|---|---|---|---|---|---|---|---|
| 11 | 36a | 13V, | 15V, | 17V, | 19V, | 21V, | 25V |
| 12 | 36b | 13V, | | | 19V, | 21V, | 25V |
| 12 | 36c | | 15V | | | | |
| 12 | 36d | | | 17V | | | |
| 13 | 36e | 13V, | 15V, | 17V | | | |
| 13 | 36f | | | | 19V, | 21V, | 25V |
| 14 | 36g | | | | 19V, | 21V, | 25V |
| 14 | 36h | 13V | | | | | |
| 14 | 36i | | 15V | | | | |
| 14 | 36j | | | 17V | | | |
| 11 | 36k | 13V, | 15V, | 17V | | | |
| 11 | 36l | | | | 19V, | 21V, | 25V |

Figure 6:
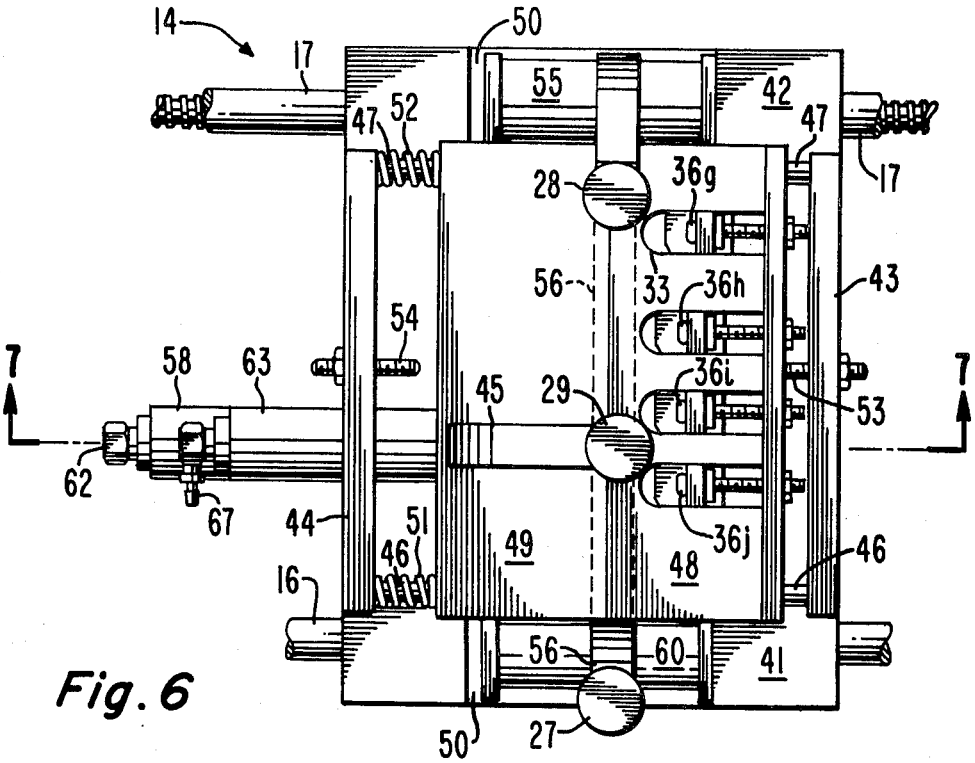
FIG. 6 is a top view of the slidable blade mount utilized at the 9 o'clock position.
Figure 7:
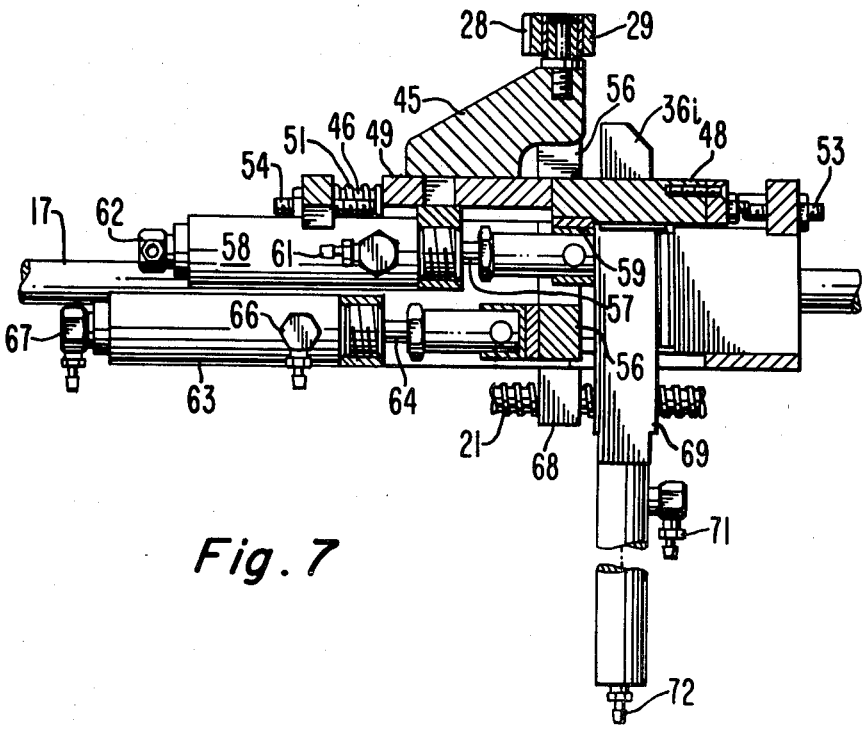
FIG. 7 is a side view partially in cross section taken along lines 7—7 of FIG. 6.

FIGS. 6 and 7 show the 9 o'clock blade mount 14 in more detail. The blade mounts 11, 12 and 13 are identical to the mount 14 except the numbers and locations of the blades vary in the manner described with respect to FIG. 5. The slidable blade mount 14 includes two slides 41 and 42 which respectively slide along the shafts 16 and 17. The slides 41 and 42 are connected by two cross members 43 and 44. Extending between the cross members 43 and 44 are two shafts 46 and 47. A blade plate 48 and a positioning plate 49 and arranged to slide in the direction of the arrow (to the right as shown) on the shafts 46 and 47. The plate 48 supports the blades 36*g* to 36*j* and the plate 49 supports the positioning bumper 29 through a support 45. Coil springs 51 and 52 are arranged around the shafts 46 and 47, respectively, between the cross member 44 and the positioning plate 49. The springs 51 and 52 bias the blade plate 48 and the positioning plate 49 away from the cross member 44 into contact with a stop 53 held by the cross member 43. Another stop 54 limits the motion of the plates 48 and 49 in the direction toward the cross member 44. A curved support 56 is attached to the slides 55 and 60 and passes under the blade plate 48 and the positioning plate 49 to support the centering bumpers 27 and 28 in the same plane as the positioning bumper 29. The centering bumpers 27 and 28, therefore, are arranged to slide on the shafts 16 and 17 by slides 55 and 60, respectively. Gaps 50 between the slides 55 and 42 and between the slides 60 and 41 allow slight motion of the centering bumpers 27 and 28 independently of the positioning bumper 29.

In FIG. 7, a shaft 57 of a cylinder 58 is connected to the blade plate 48 by a coupling 59. The cylinder 58 is provided with fittings 61 and 62 which are used to admit actuating fluid, such as air, to the cylinder to result in the motion of the shaft 57 and the blade plate 48. This motion pushes the extended blades against the springs to disengage the springs from the studs. Another cylinder 63 has a shaft 64 coupled to the support 56. The cylinder 63 also includes fittings 66 and 67 which are used to admit actuating fluid to move the cylinder 63. The slide 42 also includes a threaded nut 68 through which the lead screw 21 passes to cause the travel of the mount 14 along the shafts 16 and 17. The blade plate 48 supports a blade housing 69 in which the blade 36*i* is supported. The blades 36*g*, 36*h* and 36*j* are similarly supported on the blade support 48. Fittings 71 and 72 are provided to cause the blade 36*i* to move upwardly and downwardly within the blade housing 69 in response to the admission of fluid into the fittings 71 and 72 in much the same manner as the shaft moves in an air cylinder.

In operation, initially the springs 51 and 52 bias the blade plate 48 and the positioning plate 49 against the stop 53. In this initial position, the positioning bumper 29 is displaced forward of the centering bumpers 27 and 28. The lead screw 21 is rotated causing the entire mount assembly 14 to travel toward the center of the panel which rests on the panel support 23. The lead screws 21 and 22 are coupled and therefore the mount 12 simultaneously approaches the panel from the other side and at the same rate. The mounts 11 and 13 are driven at substantially the same rate as the mounts 12 and 14 toward the other two sides of the panel 23. Because the ratio of the horizontal-to-vertical dimensions of all panel sizes are substantially the same, all four mounts reach the panel sidewalls at substantially the same time irrespective of the size of the panel. However, the blade mounts are individually driven along the major and minor axes and therefore the operation of the system is not dependent upon the horizontal-to-vertical dimension ratio because the blade mounts on one axis can continue to move after the blade mounts on the other axis have engaged the sides of the panel. Substantial deviations in the horizontal-to-vertical ratio therefore are permissible within the inventive system. The motion of the mounts continues uninhibited until the positioning bumper 29 engages the sides of the panel. The lead screw 21 continues to rotate and the slides 41 and 42 and the centering bumpers 27 and 28 continue motion toward the panel. However, the positioning bumper 29 engages the side of the panel and thus the positioning plate 49 and the bumper 29 are inhibited from further movement toward the panel. The continual rotation of the motor brings the centering bumpers 27 and 28 into engagement with the sidewall of the panel and causes the positioning plate 49 and the blade plate 48 to slide on the shafts 46 and 47 to compress the springs 51 and 52. The centering bumpers 27 and 28 continue to move along with the slides 41 and 42 until the centering bumpers firmly engage the sides of the panel to center and properly orient the panel on the support 23 (FIG. 1). The blades 36*a* to 36*k* are then located beneath the space between the inside surface 33 of the panel 24 and the spring 37 as shown in FIG. 2 and thus are beneath the positions required to effect the disengagement of the shadow mask assembly from the panel irrespective of the panel size. When the panel 24 is properly centered, the lead screws 21 and 22 cease rotating in a manner described hereinafter. Actuating fluid is admitted to the blade housing 69 causing the blade 36*i*, and all other blades needed for the particular size of the panel, to extend between the spring 37 and inside surface 33 of the panel 24. After the required blades are raised, the cylinder 58 is actuated causing the blade plate 48 to slide toward the center of the panel along the shafts 46 and 47 independently of the positioning plate 49. The blade 36*i* thus compresses the spring 37 and disengages the spring from the stud 39. All other springs of the shadow mask assembly are simultaneously disengaged by the other operative blades. After the springs are disengaged from the studs, the cylinder 63 is actuated and the centering bumpers 27 and 28 slide on the shafts 16 and 17 away from the sides of the panel to close the gap 50 and disengage the panel from the grasp of the bumpers 27 and 28. The panel lifting surfaces 31 and 32 associated with the 12 o'clock blade mount 11 and the 6 o'clock blade mount 13 are raised to lift the panel 24 and leave the separated shadow mask assembly suspended by the blades. The motor is then reversed and the shadow mask assembly falls to panel support 23 as the blade mount 14 (and the blade mounts 11, 12 and 13 also) returns toward the home position.

In FIG. 1, a set of microswitches, 73, 74 and 75 is arranged in the proximity of the 9 o'clock blade mount 14 and a similar set of microswitches 76, 77 and 78 is arranged in the proximity of the 3 o'clock blade mount 12. Additional sets of switches 79, 80, 81 and 82,83, 84 are arranged in sets of three on opposite sides of the 12 o'clock blade mount 11. Cams 85 are affixed to the blade mounts 11, 12 and 14 and actuate and deactuate the switches 73 through 84 as the mounts travel past the switches toward a panel 24. Each of the switches 73 through 84 is used to indicate the presence of a particular size of panel 24. For example, the switch 78 is located closer to a blade mount than any of the other switches 77, 76 or 73, 74, 75. Accordingly, this switch is actuated when the mount 12 moves the distance permitted by a 25 V panel and prior to the actuation of any of the other switches 73 through 77. Accordingly, the continuous actuation of the switch 78 without the actuation of the other switches indicates a 25 V panel. When some other size panel, such as a 13 V panel is sensed, the switches 77, 76, 73 and 74 are sequentially actuated and deactuated while the switch 75 is actuated and remains actuated to indicate the presence of the 13 V panel. Hence, the continual actuation of a particular switch indicates the size of the panel sensed. Preferably, two switches, connected in series, are used for each panel size, one switch on the major axis and the other on the minor axis to assure that motion occurs along both axes before the blades are actuated. The control circuitry which responds to the switches and the pneumatic connections to energize the cylinders are standard control wiring and plumbing respectively and are within the purview of one skilled in the art and details therefore are not provided herein.

What is claimed is:

1. In a system for removing shadow mask assemblies from kinescope panels of varying sizes, wherein said panels include mounting studs arranged at particular positions with respect to the major and minor axes of said panels and wherein said shadow mask assemblies include retaining springs having apertures for engaging said studs, an improvement comprising:

a first pair of blade mounts arranged to simultaneously move linearly in opposite directions substantially parallel to said major axis;

a second pair of blade mounts arranged to simultaneously move linearly in opposite directions substantially parallel to said minor axis and independently of the motion of said first blade mounts;

each of said blade mounts including means for sensing the size of said panels and means for centering said panels;

each of said blade mounts supporting a number of blades determined by the number of stud locations at each position whereby shadow mask frame assemblies can be removed from all sizes of panels.

2. The improvement of claim 1 wherein some of said blades are operative for a plurality of panel sizes.

3. The improvement of claim 2 wherein said blade mounts include slides arranged for said linear movement with respect to said panels.

4. The improvement of claim 3 wherein said slides include a first and a second mounting plate, and wherein said means for positioning includes a positioning bumper and said means for centering includes centering bumpers spaced on opposite sides of said positioning bumper, said first mounting plate supporting said positioning bumper and said second mounting plate supporting said blade.

5. The improvement of claim 4 further including means for biasing said mounting plates toward said panel.

6. The improvement of claim 5 further including means for moving said second mounting plate independently of said first mounting plate whereby said blades deflect said springs away from said studs.

7. The improvement of claim 6 further including means for moving said centering bumpers away from said panel independently of said second mounting plate.

8. The improvement of claim 2 wherein one mount of said second pair supports one blade and the other mount of said first pair supports two blades, and wherein one mount of said first pair supports three blades and the other mount of said second pair supports four blades.

9. The improvement of claim 8 wherein said one mount of said first pair further supports an additional blade whereby two blades are operative for panels of selected sizes.

10. The improvement of claim 7 or 9 wherein at least one of said blade mounts supports an antirotation blade to prevent rotation of said panel when said blades act against said springs.

11. The improvement of claim 10 further including means for moving said panel away from said shadow mask assembly while said blades compress said springs.

12. The improvement of claim 2 or 8 wherein said blade mounts move linearly in a first plane parallel to the plane of said panel, said blades move perpendicular to said first plane to positions between said springs and the sides of panel to move linearily in a second plane parallel to said first plane to compress said springs away from said studs.

13. A method of removing shadow mask assemblies from kinescope panels of varying size, and shadow mask assemblies having apertured springs which engage studs affixed to said panels, including the steps of:

placing a panel in a first plane including a major axis and a minor axis;

linearly moving panel size sensing means, panel centering means and spring compression blades toward the sides of said panel in directions substantially parallel to said axes and to said plane, the motions along each of the axes being independent of one another;

sensing the sides of said panel to determine the size of said panel;

centering said panel with respect to said axes;

selecting a plurality of blades in accordance with the size of said panel and inserting said blades between said springs and the inside surfaces of the panel sides by displacing said blades normal to said plane; and displacing said blades against said springs toward the center of said panel and in a second plane parallel to said first plane to disengage said springs from said studs.

14. The method of claim 13 further including the step of displacing said panel from said first plane to separate said panel and said shadow mask assembly.

15. The method of claim 14 wherein said blades move toward said panel from four initial positions, and wherein the number of blades provided at each of said positions is determined by the number of possible stud locations at each of said positions.

* * * * *